United States Patent [19]

Kochilla et al.

[11] Patent Number: 4,798,657

[45] Date of Patent: Jan. 17, 1989

[54] CATHODIC PROTECTION SYSTEM

[75] Inventors: Richard J. Kochilla, Cleveland; Otto J. Esterle, Medina, both of Ohio

[73] Assignee: Corrpro Companies, Inc., Medina, Ohio

[21] Appl. No.: 4,901

[22] Filed: Jan. 20, 1987

[51] Int. Cl.[4] ..... C23F 13/00

[52] U.S. Cl. ..... 204/147; 204/196; 204/286; 204/297 R

[58] Field of Search ..... 204/147, 148, 196, 197, 204/286, 297 R

[56] References Cited

U.S. PATENT DOCUMENTS

| | | | |
|---|---|---|---|
| 3,056,738 | 10/1962 | Fischer | 204/196 |
| 3,516,917 | 6/1970 | Maurin | 204/196 |
| 3,657,084 | 4/1972 | Beer et al. | 204/197 |
| 4,171,254 | 10/1979 | Koenecke | 204/197 |

*Primary Examiner*—T. Tung

*Attorney, Agent, or Firm*—Fay, Sharpe, Beall, Fagan, Minnich & McKee

[57] ABSTRACT

A protective apparatus adapted for limiting corrosive effects of a liquid stored in a metallic storage tank. The apparatus includes anode means for carrying an impressed current to produce an electrolytic effect and inhibit corrosive interaction between the liquid and tank. Means for supplying electrical power is provided to the anode means and the anode means is supported from a side wall of the associated tank. Elastic members extend between the side wall and the anode means to maintain them in a submerged condition. Level compensator means includes a member having approximately neutral buoyancy so that it adds further weight to the apparatus as the liquid level decreases. Additionally, quick connect/disconnect means is provided to facilitate assembly and maintenance in existing and new storage tanks.

9 Claims, 3 Drawing Sheets

FIG. 1
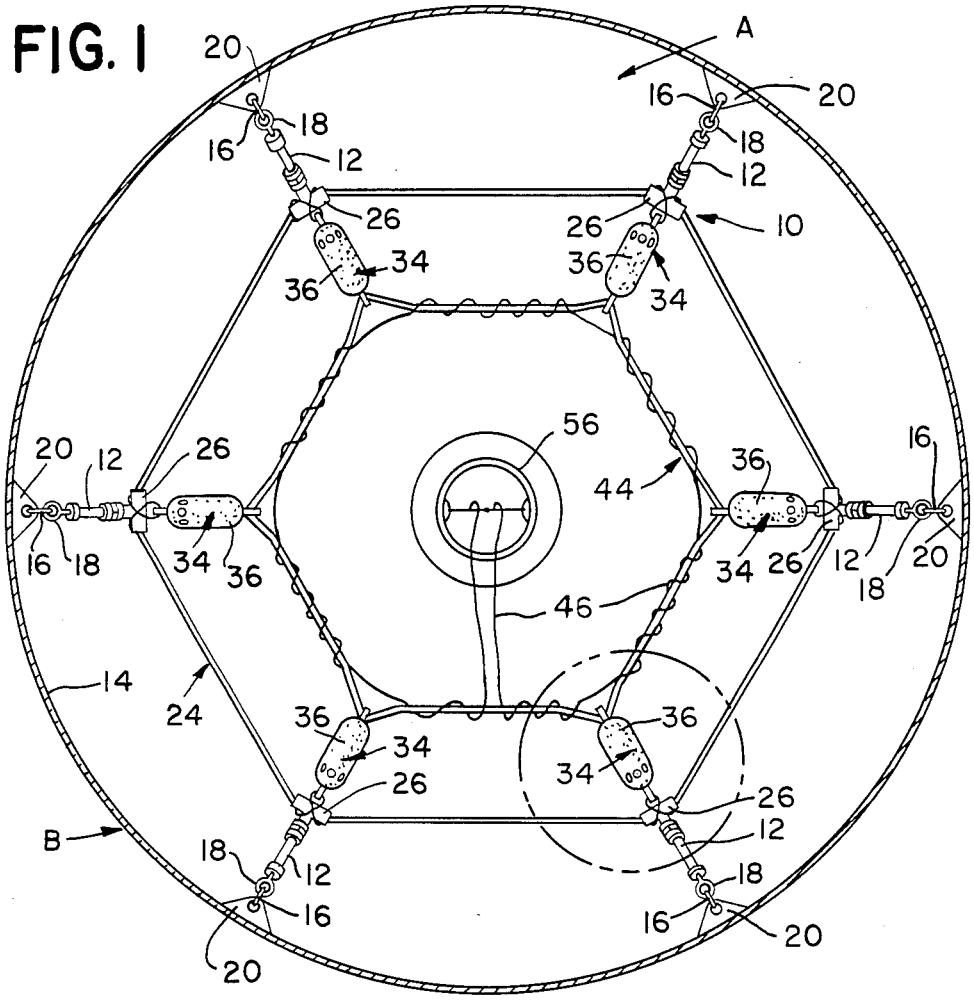
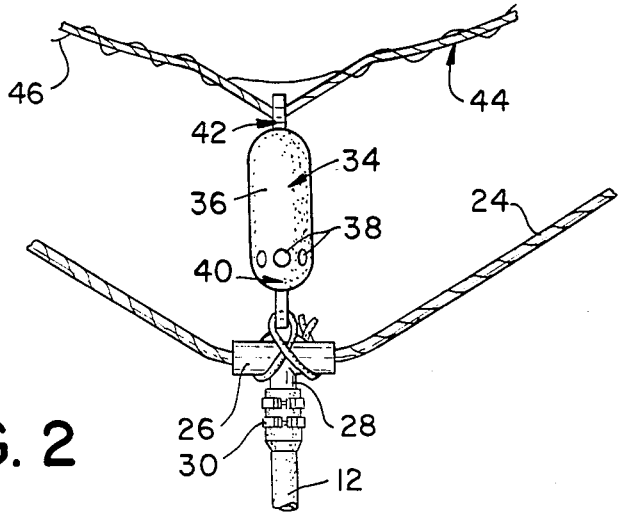
FIG. 2

FIG. 4
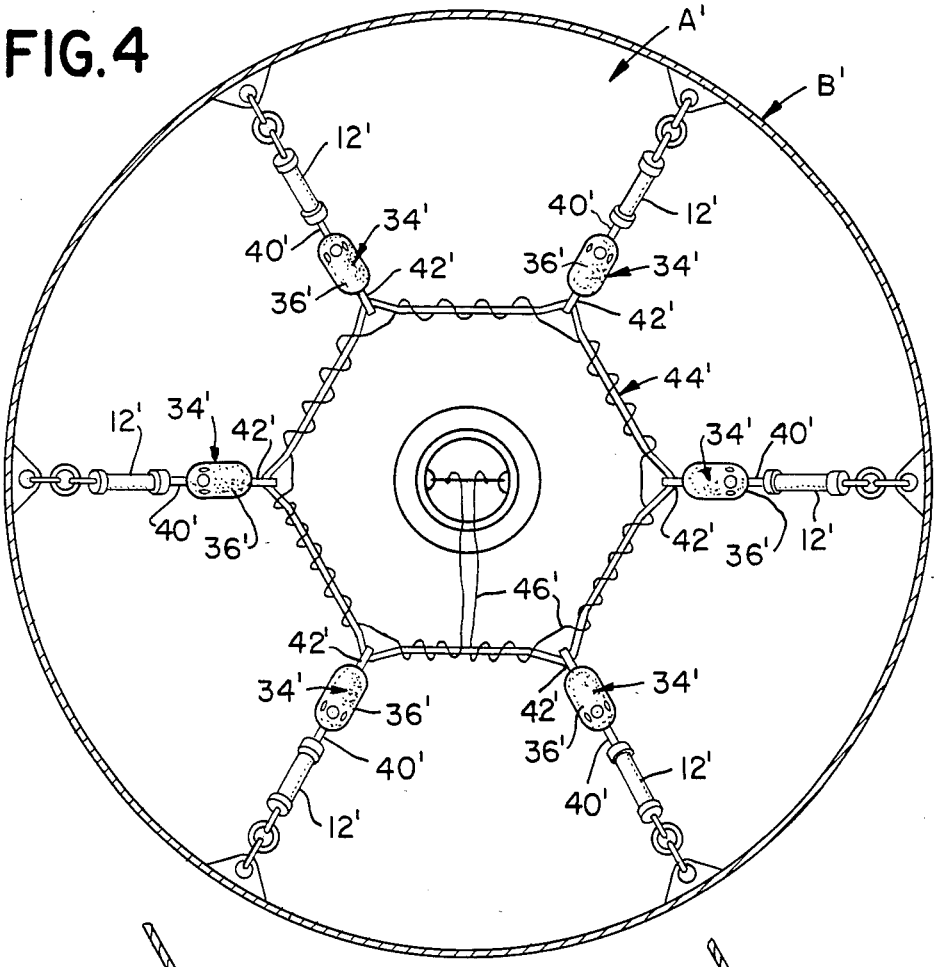
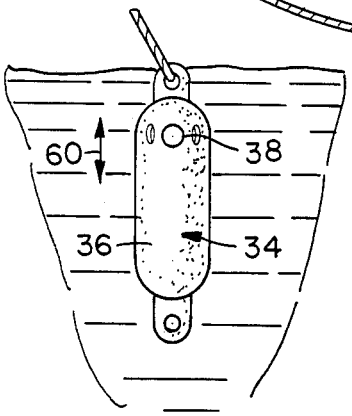
FIG. 5A
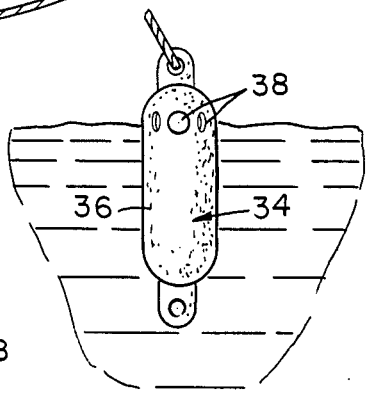
FIG. 5B
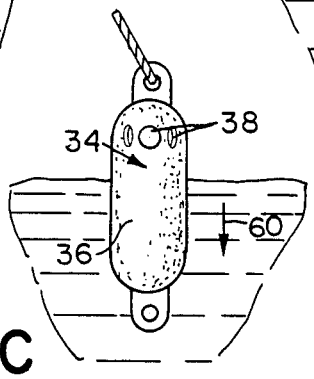
FIG. 5C

CATHODIC PROTECTION SYSTEM

BACKGROUND OF THE INVENTION

This invention pertains to the art of cathodic protection apparatus used in a metal storage tank adapted to retain vast quantities of a liquid therein and, more particularly, to a support structure for mounting the protection apparatus in the tank.

The invention is particularly applicable to a water storage tank and will be described with particular reference thereto. However, it will be appreciated that the invention has broader applications and may be advantageously employed in other tank or metal container environments and applications subject to the corrosive effect of an ionic liquid.

Tanks designed to store large quantities of water or other liquids for domestic and commercial use are well known in the art. Both high level tanks and ground storage tanks have been used for years for municipal or commercial uses. Typically, the water or other liquid corrodes the interior of the metal tank due to localized, galvanic action with the interior of the tank. Past practices have applied various coating compositions to the inner face of the tank wall in an effort to limit the corrosive interaction between the water and tank walls. This necessarily requires that the tank be emptied of its contents in order to apply the corrosion protective layer. Unless the tank is newly built and yet to be filled, this undertaking can become quite expensive due to the downtime of the tank.

Yet another protective avenue for limiting the corrosive interaction between the water and tank has been to employ some type of cathodic protection. Briefly, anodes and reference cells are suspended in the water. A direct current is impressed on the anodes whereby cathodic protection is provided and the ionic, corrosive action of the water on the metal tank walls is inhibited.

A prior cathodic protection device is illustrated in U.S. Pat. No. 3,718,554, issued Feb. 27, 1973 to Jacobs, et al. According to the Jacobs, et al. patent, a support structure includes a buoyant, submerged means formed of a material that floats in the liquid. An anode means is mounted in direct contact with the buoyant support means and flexible tie lines extend from the bottom of the tank to restrain the upward vertical movement of the buoyant support means. In this manner, a totally submerged condition of the anode means is maintained in an effort to prevent ice accumulation and damage.

Yet another construction for limiting damage due to ice accumulation in the water is disclosed in U.S. Pat. No. 3,954,591, issued May 4, 1976 to Conkling. Anodes hang by flexible suspension means extending from the roof of a water tank such that the dead weight of the anodes retains them in the liquid portion of the water tank. As ice forms at the top of the water, and the water level and ice layer move downwardly, there is a downward tensile force exerted by the ice on the suspension means resulting from adhesion therewith. This downward force reduces the diameter of the flexible suspension means which, in turn, frees the suspension means from gripping relation with the ice. Thus, the anodes are retained in the liquid.

In the Jacobs, et al. type of structure, the buoyant support means continuously urges the anode structure to the water level surface. This arrangement, likewise, continuously stresses the tie lines. On the other hand, during an extremely low water level situation, such as occurs in the summer season, there is no means to prevent the anode in a Conkling type of structure from being uncovered. That is, the anode will not always remain beneath the water level.

Further, periodic freezing and thawing of the liquid tends to deteriorate and break the flexible supports used in other similar structures which limit movement of the anode means. Still another problem associated with some of the prior art constructions is the requirement that the protection apparatus be installed in an empty tank. This severely limits retrofitting of existing tank systems with the cathodic protection due to the prohibitive expense of completely draining the water tanks.

The subject invention is deemed to overcome the above noted objections and others in a manner which is simple, economical, and may be retrofitted to existing tank systems.

SUMMARY OF THE INVENTION

According to the present invention, there is provided a protection apparatus designed to maintain anodes in a submerged condition suspended from side walls of a tank.

According to the subject invention, the protection apparatus includes elastic members extending between the side walls of the tank and the anode means. The anode means carry an impressed current from an electrical power supply means to counter the corrosive interaction between the tank and liquid stored therein.

According to another aspect of the invention, level compensator means is provided to maintain the submerged position of the anode means in the associated liquid. Preferably, the level compensator means has an approximately neutral buoyancy.

According to yet another aspect of the invention, the level compensator means includes means for receiving the associated liquid therein.

According to a still further aspect of the invention, the elastic support means extends from a magnetic anchor.

A principal advantage of the subject invention resides in the ability to retrofit existing tank systems.

Yet another advantage of the subject invention is the provision of a level compensator means which maintains the anode means submerged beneath the associated liquid level.

Another advantage of the subject invention resides in the quick connect/disconnect mounting arrangement that facilitates set up and repair of the protection apparatus.

A still further advantage of the invention is found in the limited expense of the system.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof, and wherein:

FIG. 1 is a plan view of a preferred embodiment of the subject invention attached to the side wall of a water tank or the like;

FIG. 2 is an enlarged, detailed side elevational view of the support structure utilized in FIG. 1;

FIG. 4 is a plan view of an alternate embodiment of the subject invention; and,

FIGS. 5A, 5B, and 5C are a series of views particularly illustrating the general action of the level compensating means utilized in the subject invention.

DETAILED DESCRIPTION OF THE PREFERRED AND ALTERNATE EMBODIMENTS

Figure 3:
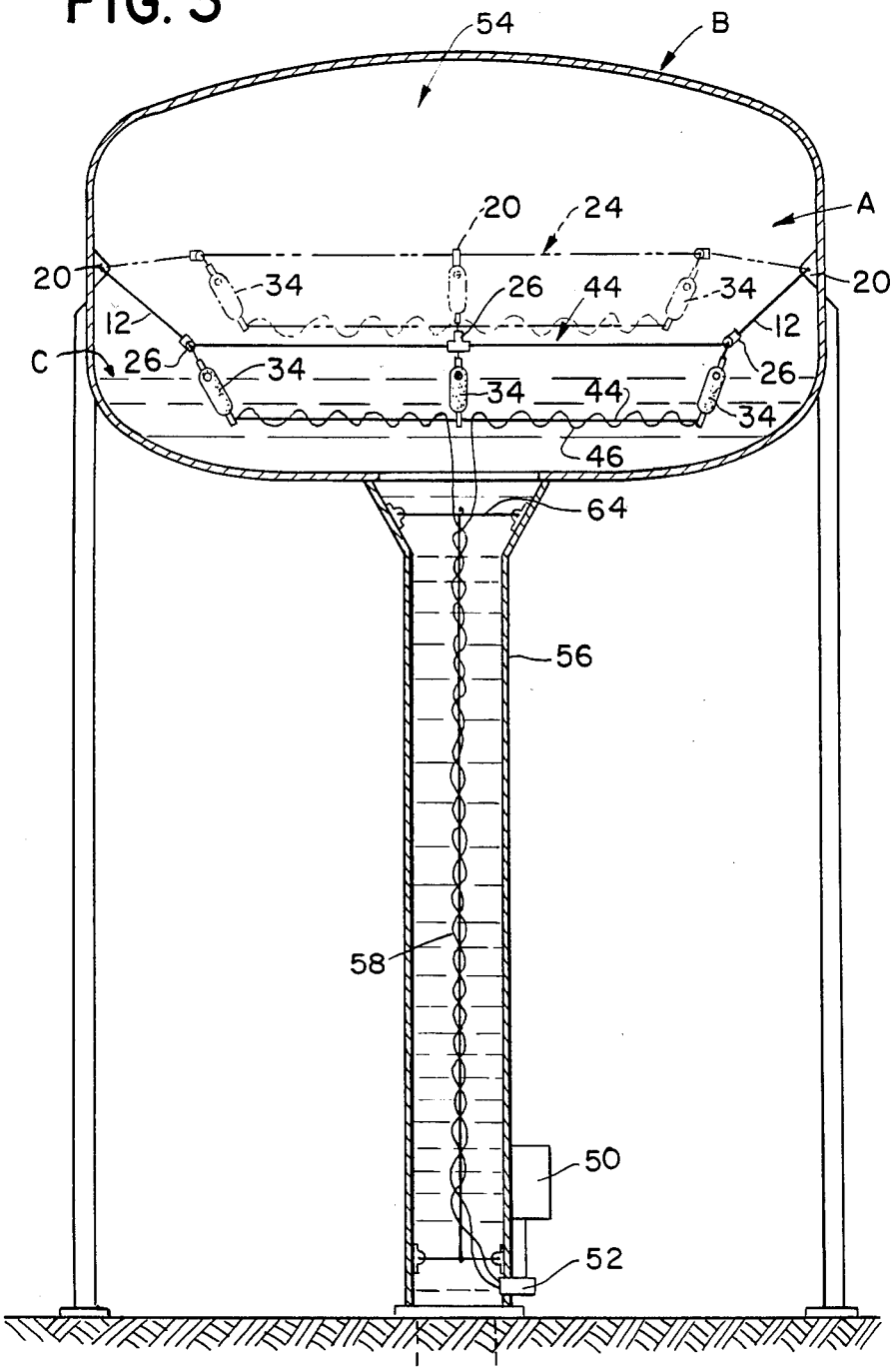
FIG. 3 is a side elevational view of the subject invention disposed in a typical water tank.

Referring now to the drawings wherein the showings are for purposes of illustrating the preferred and alternate embodiments of the invention, as well as an associated method of protecting a metallic tank, only and not for purposes of limiting same, the Figures show a cathodic protection system A supported in a conventional domestic or commercial tank B storing a liquid C such as water.

More specifically, and with reference to FIGS. 1–3, the cathodic protection system includes a spider-like support means 10 comprising plural, spaced elastic support members 12 extending generally radially inward from a side wall 14 of the tank B. The support members have a generally high degree of elasticity. Therefore, although an elastic property of extending from 50 to 200% of the support members unstretched length may be adaptable to some particular situations, preferably the support member will elongate to approximately 500–1000% of its unstretched length. For example, what is commonly known as latex tubing has met with preliminary success. Of course, it will be recognized by those skilled in the art, that any comparable material having a high capability of elongation may be used with equal success.

The support members 12 include quick connect/disconnect coupling means 16 at one end thereof. The coupling means may comprise a selective locking link that extends between an eyelet 18 attached to the elastic support member and an anchoring means 20 secured to the tank wall.

According to various embodiments of the invention, the anchoring means may comprise loops or semi-loops of round steel welded to the interior of the tank wall 14. Alternatively, the anchoring means may include loop structures that are retained on the side wall through use of adhesives or the like. According to still another embodiment of the invention, heavy duty industrial magnets, such as Nos. 71,135 and 71,150 available from Edmund Scientific Company of Barrington, N.J., provide a suitable anchor. The magnets are coated to permit use in corrosive environments such as the water storage tank under discussion. The coating has good abrasion resistance and the frame provides a convenient handle or tie-on to receive the coupling means 16. Other comparable structures may be used with equal success but these particular types of anchors have been found to meet present needs to assist in either retrofitting an existing water tank or installing a new cathodic protection system.

A first generally annular ring or hoop 24 is peripherally supported at selected points by the elastic support members 12. The hoop has a circumferential dimension substantially less than the inner peripheral dimension of the tank side wall so that the elastic members extend in a generally radial direction and center the hoop 24 in the tank. The hoop itself is preferably formed from a flexible member such as a polyester rope and secured to the respective elastic support members through use of T-type connectors 26 (FIG. 2). The T-type connectors are adapted to receive the first hoop therethrough and secure the elastic members 12 in a generally perpendicular relation with respect to the hoop. More particularly, the elastic support members receive a barbed end 28 of the T-type connector therein. A clamp 30 extends around the tubular support member and securely clamps the support member and T-type connector together. Of course, other suitable securing arrangements may be used without departing from the scope and intent of the subject invention. As illustrated in FIG. 1, six elastic members are peripherally arranged around the hoop 24 so that the hoop defines a generally hexagonal configuration. A greater or lesser number of elastic members can be used with equal success.

Still further, level compensating means 34 is attached to the first hoop 24. In accordance with a preferred embodiment of the invention, the level compensating means 34 comprises generally hollow members 36 having apertures 38 communicating with the interior thereof. The hollow members, when filled with water, or whatever other liquid is stored in the tank, have an approximately neutral buoyancy for purposes to be described further hereinbelow. A first end 40 of each hollow member is secured to the elastic members 12 (FIG. 2). Preferably the hollow member first end is tied or secured to the T-type connector 26. A second or other end 42 is likewise secured to a second annular ring or hoop 44.

As illustrated in the Figures, the second hoop 44 is disposed radially inward from the first hoop 24 and at a position generally below the first hoop (FIG. 3). That is, the second hoop has a slightly smaller peripheral dimension than the first hoop and is generally concentrically arranged therewith. With the hollow members 36 interposed between the first and second hoops, the hoops remain in a generally spaced relation from one another. An anode means such as anode assembly 46, preferably a precious metal type, is supported by the rope or other flexible member that defines the second hoop 44. This anode wire 46 extends in wrapped relation around the hoop 44 to provide a continuous ring of protection for the walls of the tank B.

As briefly indicated above, an impressed direct current is provided to the anode wire to provide an electrolytic or cathodic protection for the tank. Generally, an alternating current is supplied to an automatically controlled rectifier unit 50 to convert the alternating current to direct current. A pressure wire entrance fitting 52, here disposed at the base of the central stanchion, extends through the tank side wall. The current passes therethrough and thus the submerged tank metal surface is provided with cathodic protection.

The concentric hoop arrangement provides adequate cathodic protection for the enlarged storage portion 54 of an elevated tank as shown in FIG. 3. Likewise, this hoop arrangement is compatible with a ground storage tank also. It should also be noted that in an elevated tank system, the riser pipe 56 can also be provided with a cathodic protection apparatus. Preferably, the anode wire 58 extending the full height of the riser pipe is separate from the anode wire 46 suspended in the storage portion of the tank. The second anode wire 58 is suspended from a generally rigid support 64 and also connects to the rectifier unit 50 at a lower end of the riser pipe.

According to an alternative embodiment of the subject invention, a single hoop can be used in conjunction with the level compensating means. For ease of illustration, like elements are identified by like numerals with a primed (') suffix and new elements are identified by new numerals.

The alternative cathodic protection system A' shown in FIG. 4 also includes elastic members 12' extending generally radially inward from the tank side wall 14'. A first hoop 44' includes an anode wire 46' wrapped thereabout. The hoop is supported at selected peripheral sections by the elastic members. In accordance with this embodiment, the level compensating means 34', specifically hollow members 36', are secured to respective elastic members 12'. Since the dead weight of the hoop 44' generally maintains the elastic members 12' in a downward radially inward sloping arrangement, the level compensating means is angularly disposed with respect to the side wall of the tank. Once again, the level compensating means 34' has a generally neutral buoyancy to assist in maintaining the anode wire 46' in a submerged condition.

FIGS. 5A, 5B, and 5C generally illustrate the principles behind the level compensating means. As indicated above, the hollow members 36 (36') are provided with apertures 38 (38'). The apertures permit the ingress of the fluid C so that the level compensating means has an overall generally neutral buoyancy. As shown in FIG. 5A, the fluid level is at an intermediate range such that the dead weight of the hoop(s) arrange the elastic members 12 in generally angular relation with the tank side wall. The neutral buoyancy of the hollow members 36 maintains the level compensating means 34, in addition to the anode assembly, in a submerged condition. As represented by arrow 60, the dead weight of the hoop assemblies is generally balanced by the tension forces in support members 12.

As the fluid level C reaches a lower level (FIG. 5B), then the dead weight imposed by the hoop assemblies is generally equal to the tensile forces in the elastic members 12. An upper portion of the hollow members 36 may extend out of the fluid, but no further than apertures 38. As the water level continues downwardly, more and more of the hollow members are exposed and the tensile forces in the elastic members change due to the increased weight of the assembly (FIG. 5C). Although the actual deal weight of the assembly remains the same, the buoyant forces exerted vertically upward by the fluid on the hoop assemblies is lessened. The magnitude of the buoyant force is decreased since the weight of fluid displaced by the body is correspondingly decreased. Thus, an apparent increase in weight is provided by the level compensating means 34 since the fluid no longer supports the hoop assembly. That is, the fluid retained in the hollow members 36 adds a further weight to the hoop assembly of the cathodic protection system.

As is apparent, no matter what the level of the fluid may be, the anode wire 46 is retained below the liquid level. The level compensating means 34 may vary in its position in and out of the fluid, but its lower end portion always remains submerged. Thus, the effects of an ice layer forming along the uppermost regions of the fluid level will have no effect on the submerged anode means.

The invention has been described with reference to the preferred embodiment. Obviously modifications and alterations will occur to others upon a reading and understanding of the specification. It is intended to include all such modifications and alterations insofar as they come within the scope of the appended claims or the equivalents thereof.

Having thus described the invention, it is now claimed:

1. A protection apparatus adapted to limit the corrosive effects of a liquid stored in a metallic tank, said apparatus comprising:

a cylindrical tank having a sidewall;

a plurality of elastic support members extending generally radially inwardly from the sidewall;

a first hoop structure peripherally supported at selected portions and joined with the sidewall by the support members;

a second hoop structure disposed radially inward from the first hoop structure and generally below the first hoop structure in generally concentric relation therewith;

anode means operatively associated with the second hoop structure to carry an impressed current and produce an electrolytic effect countering the corrosive effects of the liquid; and, anode level compensator means positioned above the second hoop structure, the anode level compensator means having generally neutral buoyancy when completely submerged in the liquid and including a plurality of hollow members with apertures through which liquid flows for varying the apparent weight of the compensator means as the liquid level in the tank changes whereby the anode means remains submerged in the liquid.

2. The apparatus as defined in claim 1 wherein said elastic support members include quick connect/disconnect means facilitating set up and repair of the protection apparatus.

3. A protection apparatus adapted for limiting the corrosive effects of a liquid stored in a metal tank, said apparatus comprising:

a tank having a sidewall;

a hoop structure extending from said sidewall;

anode means extended in wrapped relation with said hoop structure to carry an impressed current to produce an electrolytic effect;

elastic support means interposed between said anode means and the tank adapted to maintain said anode means in the liquid; and level compensator means including means for receiving the liquid therein operatively associated with said support means, mid level compensating means being positioned so that anode means remains completely submerged as the liquid level decreases.

4. The apparatus as defined in claim 3 wherein said level compensator means includes a member having generally neutral buoyancy.

5. The apparatus as defined in claim 3 further comprising quick connect/disconnect means facilitating attachment of said support means to the tank.

6. The apparatus as defined in claim 3 wherein said elastic support means operatively engages a magnetic anchor.

7. The apparatus as defined in claim 3 wherein said level compensator means is operatively received on said elastic support means.

8. The protection apparatus of claim 3 further comprising electrical power supply means for said anode means.

9. A method of protecting a metallic tank against the corrosive effects of an associated liquid retained therein, comprising the steps of:

securing anode means to a sidewall of said tank;

completely submerging anode means in the associated liquid;

filling a hollow, apertured level compensating means with the associated liquid;

emptying the associated liquid from the level compensating means as the associated liquid level of the tank decreases to the level of the level compensating means to increase its apparent weight;

stretching an elastic support member for the anode means with the increased apparent weight of the level compensating means; and, continuously retaining the anode means submerged within the liquid.

* * * * *